US010974933B2

(12) United States Patent
Yumoto et al.

(10) Patent No.: US 10,974,933 B2
(45) Date of Patent: Apr. 13, 2021

(54) CONTROL DEVICE FOR LIFTING MAGNET

(71) Applicant: KOBELCO CONSTRUCTION MACHINERY CO., LTD., Hiroshima (JP)

(72) Inventors: Natsuki Yumoto, Hiroshima (JP); Hideki Yoshihara, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 230 days.

(21) Appl. No.: 16/320,566

(22) PCT Filed: Jun. 16, 2017

(86) PCT No.: PCT/JP2017/022238
§ 371 (c)(1),
(2) Date: Jan. 25, 2019

(87) PCT Pub. No.: WO2018/025523
PCT Pub. Date: Feb. 8, 2018

(65) Prior Publication Data

US 2019/0270618 A1 Sep. 5, 2019

(30) Foreign Application Priority Data

Aug. 2, 2016 (JP) ..... JP2016-152022

(51) Int. Cl.
*B66C 1/08* (2006.01)
*H01F 7/18* (2006.01)
*H01F 7/20* (2006.01)

(52) U.S. Cl.
CPC ..... *B66C 1/08* (2013.01); *H01F 7/18* (2013.01); *H01F 7/206* (2013.01); *B66C 2700/087* (2013.01)

(58) Field of Classification Search
CPC ..... B66C 1/08; B66C 2700/087; H01F 7/18; H01F 7/206; H01F 7/064
(Continued)

(56) References Cited

U.S. PATENT DOCUMENTS 5,977,730 A 11/1999 Clutter et al.
8,491,025 B2 * 7/2013 Pollock ..... B66C 13/16 294/65.5
(Continued)

FOREIGN PATENT DOCUMENTS

CN 204631665 U 9/2015
EP 0 854 408 A2 7/1998
(Continued)

OTHER PUBLICATIONS

Combined Chinese Office Action and Search Report dated Aug. 28, 2019, in Patent Application No. 201780047832.0, 14 pages (with unedited computer generated English translation).
(Continued)

*Primary Examiner* — Gary L Laxton
(74) *Attorney, Agent, or Firm* — Oblon, McClelland, Maier & Neustadt, L.L.P.

(57) ABSTRACT

When at least one of a value a detected output current to a magnet and a magnet load defined by the following formula is equal to or larger than a threshold value predetermined for the value of the detected output current or a threshold value predetermined for the magnet load, a controller constituting a control device outputs, to a control circuit, a command to decrease voltage applied to the magnet from next attracting operation. Magnet load=excitation ratio×I×V . . . ; wherein excitation ratio: excitation time/(excitation time+non-excitation time); I: value of the output current; V: voltage applied to a lifting magnet.

6 Claims, 6 Drawing Sheets

(58) Field of Classification Search
USPC ..... 361/144
See application file for complete search history.

(56) References Cited

U.S. PATENT DOCUMENTS

| | | | | |
|---|---|---|---|---|
| 10,224,137 | B2 * | 3/2019 | Shiki | E02F 3/965 |
| 2008/0204948 | A1 | 8/2008 | Zhang et al. | |
| 2017/0240387 | A1 * | 8/2017 | Morimoto | F02D 29/00 |
| 2018/0142800 | A1 * | 5/2018 | Kato | F16K 31/0675 |

FOREIGN PATENT DOCUMENTS

| | | | |
|---|---|---|---|
| JP | 6-100284 | A | 4/1994 |
| JP | 6-171886 | A | 6/1994 |
| JP | 2007-45615 | A | 2/2007 |
| JP | 2008-222368 | A | 9/2008 |
| JP | 5409394 | B2 | 2/2014 |

OTHER PUBLICATIONS

International Search Report dated Aug. 29, 2017 in PCT/JP2017/022238 filed Jun. 16, 2017.
Extended European Search Report dated Jul. 10, 2019 in European Patent Application No. 17836630.8, 6 pages.

* cited by examiner

CONTROL DEVICE FOR LIFTING MAGNET

TECHNICAL FIELD

The present invention relates to a control device for a lifting magnet.

BACKGROUND ART

When magnetic waste is attached and moved, a magnet called a lifting magnet is used. A conventional technique relating to control of this lifting magnet (hereinafter simply referred to as a magnet) is described in Patent Literature 1 below.

Patent Literature 1 discloses that control is performed to raise voltage applied to the magnet when resistance increases due to a temperature rise of the magnet and current decreases. Thus, the technique described in Patent Literature 1 keeps attracting force of the magnet constant.

However, the control described in Patent Literature 1 has the following problems. The control described in Patent Literature 1 may fall into a vicious circle of a temperature rise of the magnet, that is, an increase in temperature of the magnet, a decrease in current, an increase in applied voltage, and the temperature rise of the magnet. As a result, the technique described in Patent Literature 1 causes problems such as deterioration of the magnet and an increase in load on a power source.

CITATION LIST

Patent Literature

Patent Literature 1: JP 06-100284 A

SUMMARY OF INVENTION

The present invention has been made in view of the above circumstances, and it is an object of the present invention to provide a control device for a lifting magnet that can prevent deterioration of a magnet and an increase in load on a power source.

One aspect of the present invention is directed to a control device for a lifting magnet, the control device including: a control circuit for controlling power supply from a power source to the lifting magnet; a current detector for detecting output current to the lifting magnet; and a controller for receiving a signal from the current detector and outputting a command to the control circuit, wherein when at least one of a value of the detected output current and a magnet load defined by the following formula (1) is equal to or larger than a first threshold value predetermined for the value of the detected output current or a second threshold value predetermined for the magnet load, the controller outputs, to the control circuit, a command to decrease voltage applied to the lifting magnet from next attracting operation.

$$\text{Magnet load}=\text{excitation ratio}\times I\times V \quad (1)$$

Excitation ratio: excitation time/(excitation time+non-excitation time)

I: value of the output current

V: voltage applied to the lifting magnet

According to this configuration, an excessive temperature rise of the magnet can be suppressed, so that deterioration of the magnet can be prevented. Further, it is also possible to prevent a load on the power source from being increased due to the control for decreasing the applied voltage.

DESCRIPTION OF EMBODIMENT

Hereinafter, an embodiment for carrying out the present invention will be described with reference to the drawings. Note that a lifting magnet (magnet) in the present invention is used by being attached to, for example, a work machine. As an example of the work machine having the lifting magnet, there is a handling machine (also called a lifting magnet machine) described in Japanese Unexamined Patent Application Publication No. 2007-45615.

(Configuration of Work Machine)

Figure 1:
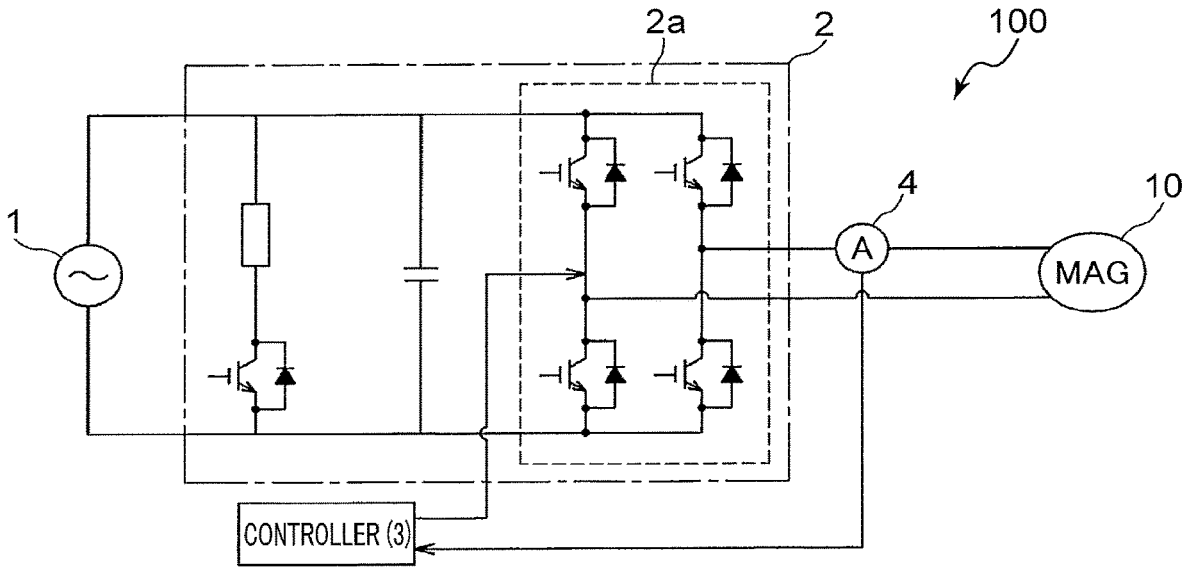
FIG. 1 is a circuit diagram showing a circuit configuration of a control device according to an embodiment of the present invention.
Figure 6:
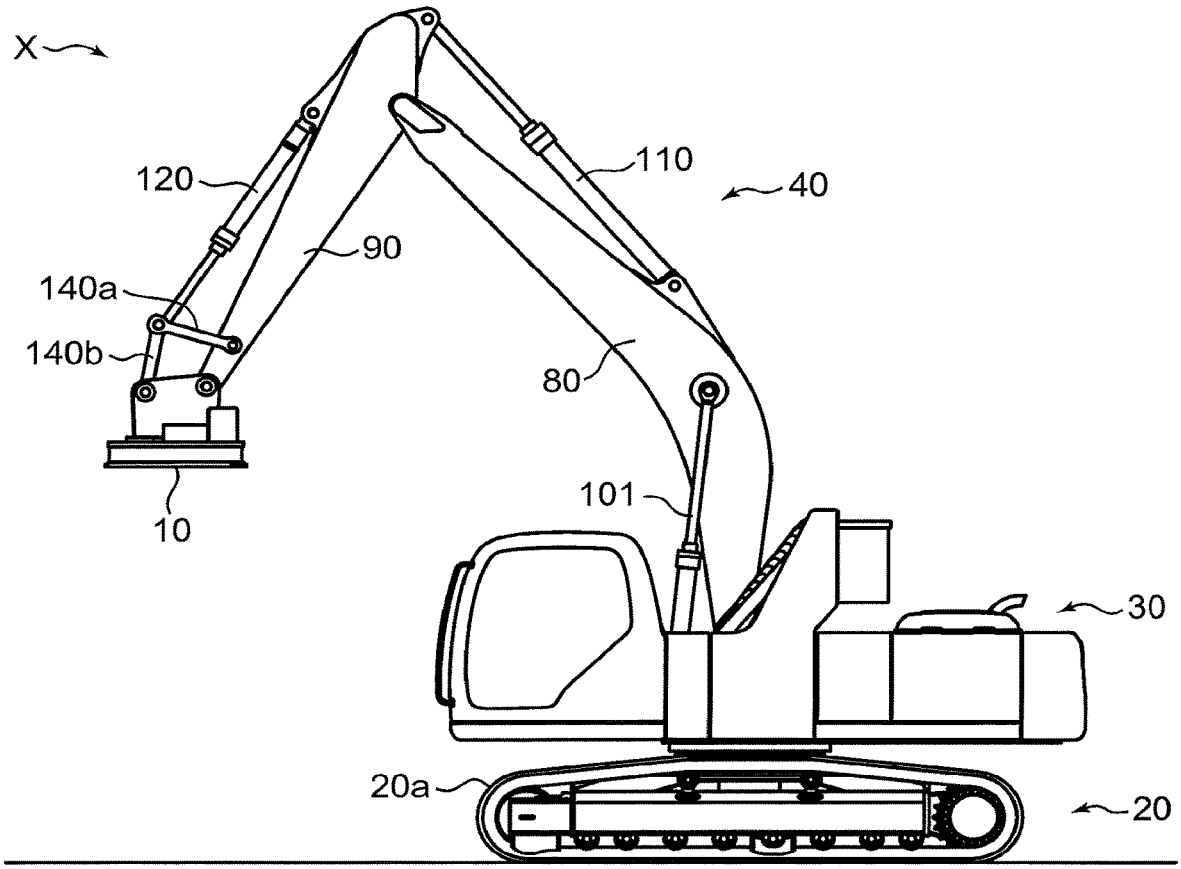
PRIOR ART FIG.6
FIG. 6 is a view showing an overall configuration of a work machine on which a lifting magnet (magnet) is mounted.

FIG. 6 is a view showing an overall configuration of a work machine X on which a lifting magnet is mounted. The work machine X is shown in FIG. 1 of JP 2007-45615 A. The work machine X includes a lower travelling body 20 provided with a crawler 20*a*, an upper slewing body 30 pivotably mounted on the lower travelling body 20, an attachment 40 installed in a front portion of the upper slewing body 30 so that the attachment 40 can be raised and lowered, and a magnet 10 attached to a tip portion of the attachment 40. By magnetizing the magnet 10, magnetic waste can be attracted. As the work machine X, a handling machine is adopted.

The attachment 40 includes a boom 80 and an arm 90 connected to a tip portion of the boom 80. The magnet 10 is swingably attached to a tip portion of the arm 90.

The boom 80 is raised and lowered by expansion and contraction operation of a boom cylinder 101. The arm 90 is swung by expansion and contraction operation of an arm cylinder 110. The magnet 10 is swung with respect to the arm 90 via links 140*a* and 140*b* by expansion and contraction operation of a magnet cylinder 120.

(Configuration of Control Device)

An embodiment of a control device 100 for a lifting magnet according to the present invention will be described with reference to FIG. 1. A configuration of the control device 100 for the lifting magnet is not limited to the configuration shown in FIG. 1.

As shown in FIG. 1, the control device 100 for a magnet 10 (lifting magnet) of the present embodiment includes a control circuit 2 for controlling power supply from a power source 1 to the magnet 10, an ammeter 4 serving as a current detector for detecting output current flowing from the power source 1 to the magnet 10 via the control circuit 2, and a controller 3 for receiving a signal from the ammeter 4 and outputting a command to the control circuit 2.

The power source 1 is, for example, a generator connected to an engine. A switching circuit 2*a* constituting the control circuit 2 includes four switching elements connected in a full bridge. The switching circuit 2*a* increases or decreases applied voltage to be applied to the magnet 10 by switching voltage generated by the power source 1 with the four switching elements. Note that the voltage applied to the magnet 10 is DC voltage and the voltage generated by the power source 1 is AC voltage. The AC voltage generated by the power source 1 is converted into the DC voltage by the control circuit 2. The controller 3 outputs, to the switching circuit 2*a*, a command to determine ON time of each switching element so that the voltage applied to the magnet 10 has a desired value. The ammeter 4 transmits current applied to the magnet 10 (hereinafter referred to as "output current") as a signal to the controller 3, and the controller 3 fetches the signal. The controller 3 is constituted by a computer including, for example, a CPU and memories such as a ROM and a RAM.

(Overall Configuration of Control)

Regarding the control of the voltage applied to the magnet 10 by the controller 3, an overall configuration of the control will be described first.

Figure 2:
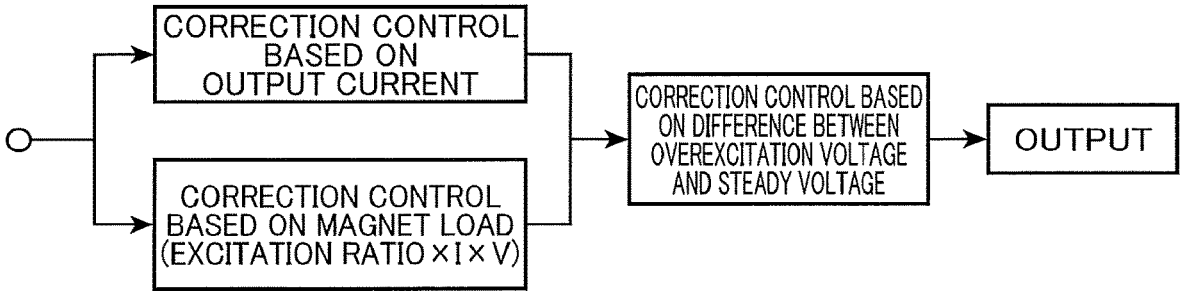
FIG. 2 is a block diagram showing an overall configuration of control.

As shown in FIG. 2, the control of the applied voltage by the controller 3 according to the present embodiment includes three types of control, that is, "correction control based on output current", "correction control based on a magnet load", and "correction control based on a difference between overexcitation voltage and steady voltage".

Also, "the correction control based on the output current" and "the correction control based on the magnet load" are in a parallel relationship, and "the correction control based on the difference between the overexcitation voltage and the steady voltage" is placed after the above two types of correction control. When a condition in one of "the correction control based on the output current" and "the correction control based on the magnet load" is satisfied, a correction value under the satisfied condition is appropriately corrected based on "the correction control based on the difference between the overexcitation voltage and the steady voltage". The corrected value is then determined as a correction value of the applied voltage. When the conditions in both "the correction control based on the output current" and "the correction control based on the magnet load" arc satisfied at the same time, a larger correction value of the two is appropriately corrected based on "the correction control based on the difference between the overexcitation voltage and the steady voltage". The corrected value is then determined as the correction value of the applied voltage.

<Correction Control Based on Output Current>

Figure 3:
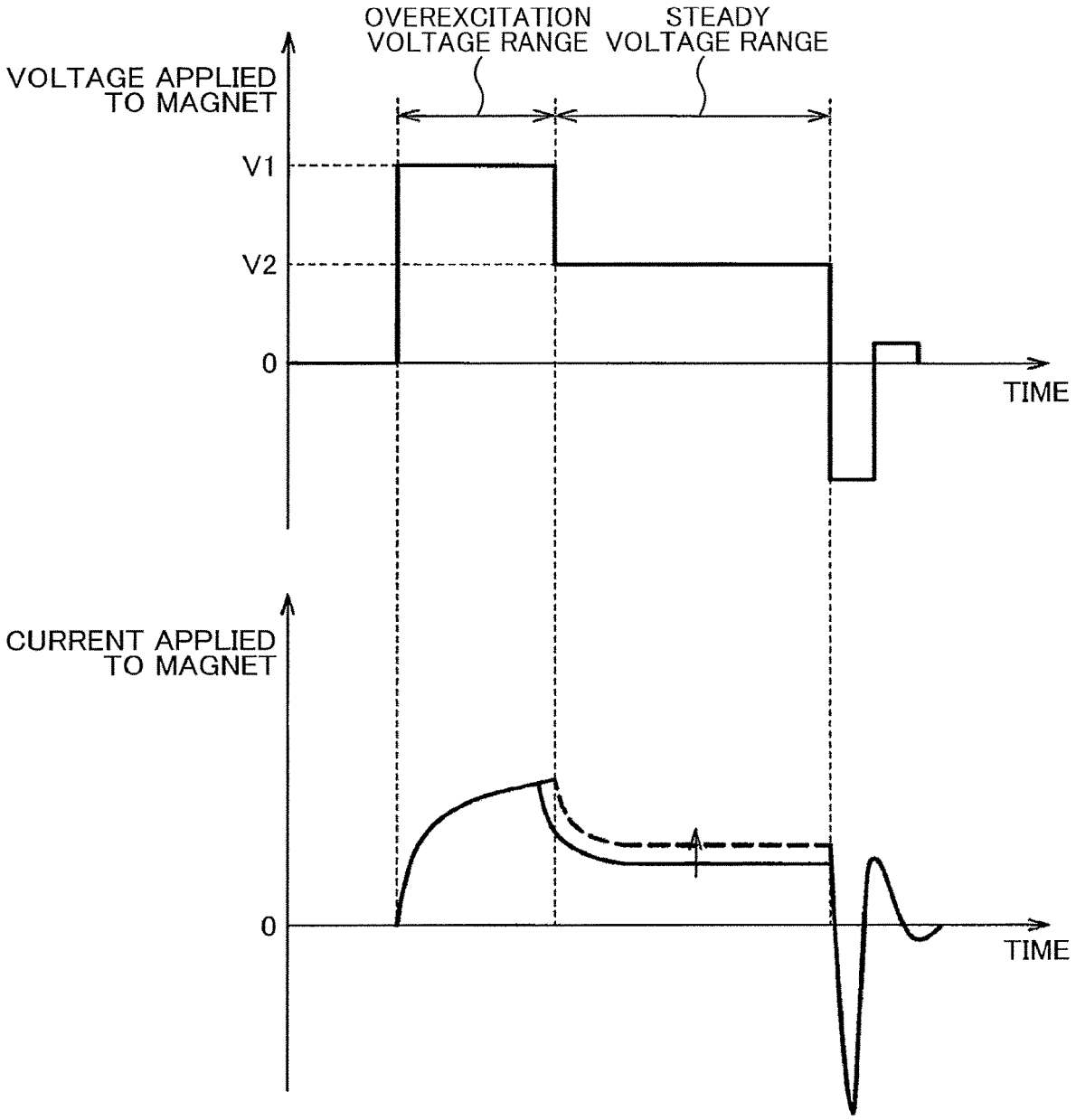
FIG. 3 is a graph showing temporal changes in voltage applied to a magnet and output current.
Figure 4:
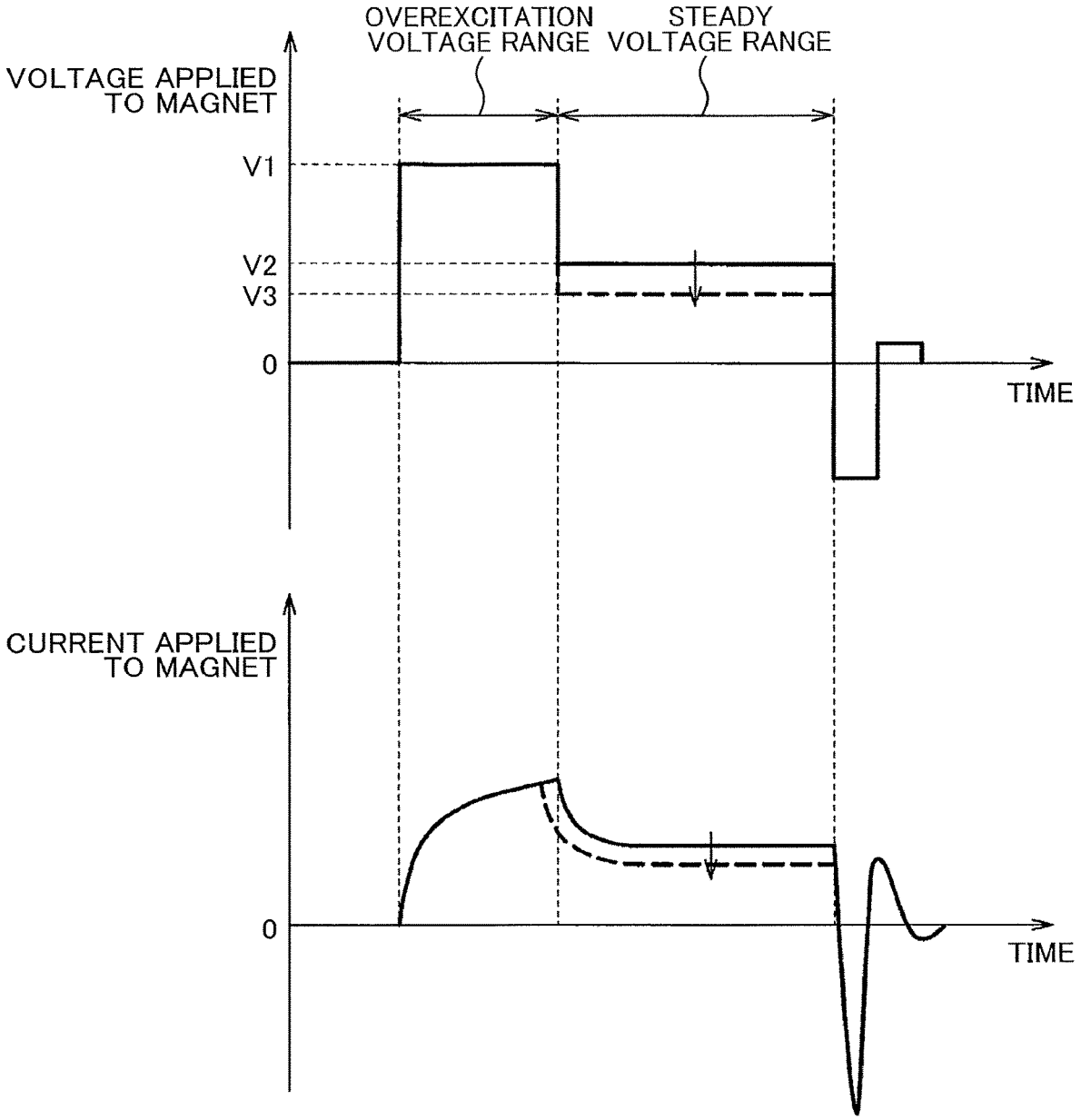
FIG. 4 is a graph showing temporal changes in voltage applied to the magnet and output current.

"The correction control based on the output current" will be described. FIGS. 3 and 4 are graphs showing temporal changes in the voltage applied to the magnet 10 and the output current (the current applied to the magnet).

First, a basic temporal change in the voltage applied to the magnet 10 during a period from a start of excitation to release of the magnet 10 will be described. By an output value command from the controller 3 to the control circuit 2, immediately after the start of excitation, the magnet 10 is excited with a voltage V1 (an overexcitation voltage) (an overexcitation voltage range). Excitation time at this voltage V1 is, for example, 3 to 5 seconds. Thereafter, the magnet 10 is excited with a voltage V2 (a steady voltage, V2<V1). The magnet 10 is released when a movement of magnetic waste is finished. A period from the excitation with the voltage V2 to the release of the magnet 10, that is, a length of a steady voltage range (excitation time), varies depending on operation, and is, for example, 10 to 15 seconds.

The excitation to the magnet 10 is started, for example, when operation of turning on an attraction switch is input by an operator of the work machine X. The release of the magnet 10 is started, for example, when operation of turning on a release switch is input by the operator of the work machine X.

In this manner, the voltage applied to the magnet 10 is generally configured by combining the overexcitation voltage and the steady voltage. The controller 3 controls the control circuit 200 such that the overexcitation voltage which is voltage higher than the steady voltage is applied to the magnet 10 at an initial stage of the excitation and is switched to the steady voltage after a lapse of fixed time (for example, 3 to 5 seconds). The applied voltage (the voltage applied to the magnet) shown by solid lines in FIGS. 3 and 4 is applied voltage determined from desired magnet attracting force in a normal state, that is, applied voltage in the normal state which is not corrected.

Here, it is assumed that temperature of the magnet 10 decreases due to some factor. When the temperature of the magnet 10 decreases, electric resistance of the magnet 10 decreases, and as shown by a dotted line in a lower graph of FIG. 3, the current applied to the magnet (the output current to the magnet 10) increases.

The controller 3 averages current detection values in the steady voltage range of the output current to the magnet 10 detected by the ammeter 4. When an average value of the current detection values is equal to or larger than a predetermined threshold value A (a first threshold value), as shown by a dotted line in an upper graph of FIG. 4, the controller 3 reduces the steady voltage to be applied to the magnet 10 from the voltage V2 to a voltage V3 (V3<V2) from next attracting operation. Then, the output current to the magnet 10 decreases as shown by a dotted line in a lower graph of FIG. 4, and is returned to an output current value shown by a solid line in the lower graph of FIG. 3. As a result, attracting force (magnetic force) of the magnet 10, which has become excessive attracting force (magnetic force) due to the increased applied current, is corrected to appropriate attracting force (magnetic force).

Here, for example, when the average value of the current in the steady voltage range is equal to or larger than the threshold value A, the controller 3 may determine a correction amount of the applied voltage (a first correction amount) so that the correction amount increases as an excess of the average value of the current with respect to the threshold value A increases. Then, the controller 3 may output, to the control circuit 200, a command to decrease the applied voltage by the correction amount from a currently set applied voltage. It should be noted that the controller 3 may store in a memory a map in which a relationship between the correction amount and the excess of the average value of the current with respect to the threshold value A is predetermined, and may determine the correction amount using this map.

<Correction Control Based on Magnet Load>

Next, "the correction control based on the magnet load" will be described. When a magnet load defined by the following formula (1) is equal to or larger than a predetermined threshold value B (a second threshold value), the controller 3 also outputs, to the switching circuit 2*a* of the control circuit 2, a command to decrease the voltage applied to the magnet 10 from next attracting operation.

$$\text{Magnet load} = \text{excitation ratio} \times I \times V \quad (1)$$

Excitation ratio: excitation time/(excitation time+non-excitation time)

I: output current to the magnet 10

V: voltage applied to the magnet 10

The excitation time is, literally, time during which the magnet 10 is excited. Referring to FIG. 3, the excitation time includes, for example, the overexcitation voltage range and the steady voltage range. Note that, in addition to the overexcitation voltage range and the steady voltage range, the excitation time may include a removal range for removing residual magnetism of the magnet 10. In an example of FIG. 3, the removal range includes a period in which the voltage is negative subsequently to the steady voltage range and a period in which the voltage is positive subsequently to a lapse of the negative period.

The non-excitation time is, literally, time during which the magnet 10 is not excited. Referring to FIG. 3, the non-excitation time corresponds to, for example, a period excluding the excitation time. For example, the period excluding the excitation time may include a period in which the voltage V is 0 and the removal range, or may include only the period in which the voltage V is 0.

Figure 5:
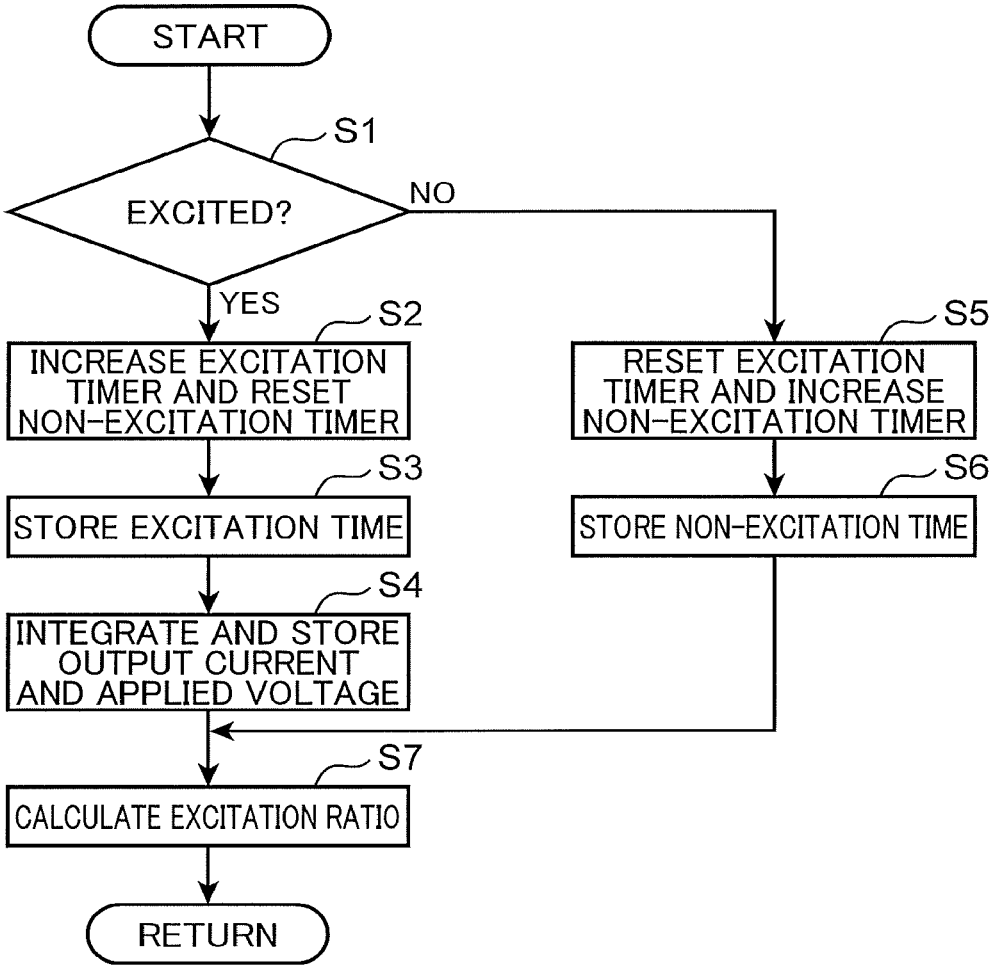
FIG. 5 is a flowchart showing a calculation flow of an excitation ratio.

A calculation flow of the excitation ratio will be described with reference to FIG. 5. Note that the calculation flow in FIG. 5 is repeated, for example, at a constant cycle. If the magnet 10 is excited (YES in S1), the controller 3 increases excitation time of an excitation timer for detecting the excitation time and resets a non-excitation timer for detecting the non-excitation time (S2). Next, the controller 3 stores the excitation time detected by the excitation timer in the memory (S3). Next, the controller 3 integrates the output current I to the magnet 10 to stores the output current I in the memory, and integrates the voltage V applied to the magnet 10 to store the voltage V in the memory (S4). Here, the controller 3 may reset an integrated value of the output current I and an integrated value of the applied voltage V stored in the memory every time one attracting operation is completed.

On the other hand, if the magnet 10 is not excited (NO in S1), the controller 3 resets the excitation timer and increases non-excitation time of the non-excitation timer (S5).

Next, the controller 3 stores the non-excitation time detected by the non-excitation timer in the memory (S6). Next, the controller 3 reads the excitation time and the non-excitation time stored in the memory in S3, S6 from the memory, and calculates the excitation ratio=excitation time/(excitation time+non-excitation time) (S7). Note that, since the excitation timer is reset in S5, the excitation time stored in S3 when the magnet 10 is released indicates the excitation time in one attracting operation. Further, since the non-excitation timer is reset in S2, the non-excitation time stored in S6 when the excitation of the magnet 10 is started indicates time from completion of the one attracting operation to start of next attracting operation. Therefore, the excitation ratio corresponding to the one attracting operation is calculated by a process in S7 when the next attracting operation is started.

Note that, when the magnet 10 is released after the excitation of the magnet 10 is started, the controller 3 calculates an average value of the output current I and an average value of the applied voltage V by using the output current I and the applied voltage V integrated in S4. Here, the controller 3 may calculate the average value of the output current I and the average value of the applied voltage V by dividing the integrated output current I and the integrated applied voltage V by the excitation time, respectively.

Then, the controller 3 calculates a magnet load by multiplying the excitation ratio calculated in the above-mentioned S7, the average value of the output current I, and the average value of the applied voltage V. If the calculated magnet load is equal to or larger than a predetermined threshold value B, the controller 3 outputs, to the control circuit 2, a command to reduce the voltage applied to the magnet 10 from the next attracting operation. As a result, the controller 3 can suppress a temperature rise of the magnet 10. For example, the controller 3 may decrease both the overexcitation voltage and the steady voltage following the overexcitation voltage.

Here, for example, when the magnet load is equal to or larger than the threshold value B, the controller 3 may determine a correction amount of the applied voltage (a second correction amount) such that the correction amount increases as an excess of the magnet load with respect to the threshold value B increases. Then, the controller 3 may output, to the control circuit 200, a command to decrease the applied voltage by the correction amount from a currently set applied voltage. It should be noted that the controller 3 may store in the memory a map in which a relationship between the correction amount and the excess of the magnet load with respect to the threshold value B is predetermined, and may determine the correction amount using this map. In this case, the same value or different values may be adopted for a correction amount for the overexcitation voltage and a correction amount for the steady voltage.

Here, the conditions (the average value of the output current is equal to or larger than the threshold value A, and the magnet load is equal to or larger than the threshold value B) in both "the correction control based on the output current" and "the correction control based on the magnet load" are sometimes simultaneously satisfied. In this case, the controller 3 may adopt the larger one of the correction amounts obtained by both of the control.

As described above, the correction for decreasing the steady voltage is exemplified in "the correction control based on the output current", and the correction for decreasing both the overexcitation voltage and the steady voltage is exemplified in "the correction control based on the magnet load". In this case, what is common to both of the control is correction of the steady voltage. Therefore, the controller 3 may adopt a larger correction amount of the correction amounts obtained by both of the control on the steady voltage (a decrease amount of the steady voltage).

Note that, with regard to the correction amount (decrease amount) of the overexcitation voltage, a larger one of the correction amount in "the correction control based on the magnet load" and a correction amount in "the correction control based on the difference between the overexcitation voltage and the steady voltage" described below is applied.

<Correction Control Based on Difference Between Overexcitation Voltage and Steady Voltage>

Next, "the correction control based on the difference between the overexcitation voltage and the steady voltage" will be described. When the difference between the overexcitation voltage and the steady voltage of the voltage applied to the magnet 10 becomes equal to or larger than a predetermined value, the controller 3 outputs, to the switching circuit 2*a* of the control circuit 2, a command to decrease the overexcitation voltage from next attracting operation. Note that the above-described predetermined value is stored in advance in the memory. Further, when the overexcitation voltage and the steady voltage are corrected by "the correction control based on the output current" or "the correction control based on the magnet load", the corrected values are adopted. As a result, the difference between the overexcitation voltage and the steady voltage is limited, the difference between the two is prevented from becoming excessive, and a decrease in the magnetic force when shifting from the overexcitation voltage range to the steady voltage range can be prevented.

(Modifications)

In the above embodiment, regarding "the correction control based on the output current", the average value of the current detection values in the steady voltage range of the output current to the magnet 10 detected by the ammeter 4 is compared with the threshold value A. However, this is only an example. In the present invention, the average value of all the current detection values in the overexcitation voltage range and the steady voltage range (the excitation period of the magnet 10) may be compared with the threshold value A.

Further, in the above embodiment, regarding "the correction control based on the output current", the steady voltage of the voltage applied to the magnet 10 is decreased. However, this is only an example. In the present invention, both the overexcitation voltage and the steady voltage may be decreased, or the overexcitation voltage may be decreased instead of the steady voltage.

Furthermore, in the above embodiment, with respect to "the correction control based on the magnet load", both the overexcitation voltage and the steady voltage of the voltage applied to the magnet 10 are decreased. However, this is only an example. In the present invention, only one of the overexcitation voltage and the steady voltage may be decreased.

Further, in the present invention, regarding the three types of control: "the correction control based on the output current", "the correction control based on the magnet load", and "the correction control based on the difference between the overexcitation voltage and the steady voltage", that is, the overall configuration of control, "the correction control based on the difference between the overexcitation voltage and the steady voltage" may be omitted. Further, in the present invention, with respect to "the correction control based on the output current" and "the correction control based on the magnet load", either one of the control may be omitted.

Besides, it goes without saying that various modifications can be made to the present invention within a range that can be assumed by those skilled in the art.

(Function Effects)

In the present invention, when at least one of a value of the output current to the magnet 10 and a magnet load defined by the formula (1) is equal to or larger than a threshold value A predetermined for the value of the output current or a threshold value B predetermined for the magnet load, the controller 3 performs control to decrease voltage applied to the magnet 10.

According to this configuration, since an excessive temperature rise of the magnet 10 can be suppressed, deterioration of the magnet 10 can be prevented. In addition, according to this configuration, since the applied voltage is decreased, it is also possible to prevent a load on the power source 1 from becoming large. Furthermore, according to this configuration, if at least one of the condition that the value of the output current is equal to or larger than the threshold value A and the condition that the magnet load is equal to or larger than the threshold value B is satisfied, the control to decrease the applied voltage is executed. Accordingly, it is possible to prevent the deterioration of the magnet 10 more reliably.

In the present invention, in a case where the controller 3 performs control to decrease the voltage applied to the magnet 10 when the value of the detected output current to the magnet 10 is equal to or larger than the threshold value A, it is preferable that the controller 3 output, to the control circuit 2, a command to decrease the applied voltage when an average value of the values of the output current in a steady voltage range of the applied voltage is equal to or larger than the threshold value A.

This is because the output current in the steady voltage range is more stable than the output current in the overexcitation voltage range. In general, the overexcitation voltage range has a shorter time than the steady voltage range, and responsiveness of a current rise changes depending on a material to be attracted and is not stable. However, the steady voltage range is not like this. Therefore, the present invention enables stable control by using the output current in the steady voltage range.

Further, in the present invention, in a case where the controller 3 performs control to decrease the voltage applied to the magnet 10 when the value of the detected output current to the magnet 10 is equal to or larger than the threshold value A, it is preferable that the controller 3 output, to the control circuit 2, a command to decrease steady voltage of the applied voltage.

According to this configuration, by decreasing the steady voltage, the overexcitation voltage at the initial stage of excitation can be maintained without being corrected. As a result, the magnetic force at the initial stage of excitation can be maintained, and sufficient magnetic flux can be secured.

Furthermore, in the present invention, in a case where the controller 3 performs control to decrease the applied voltage when the magnet load defined by the formula (1) is equal to or larger than the threshold value B, it is preferable that the controller 3 output, to the control circuit 200, a command to decrease both overexcitation voltage of the applied voltage and the steady voltage following the overexcitation voltage.

According to this configuration, a temperature rise of the magnet 10 can be suppressed more as compared to a case where only one of the overexcitation voltage and the steady voltage is decreased.

Furthermore, in the present invention, when a difference between the overexcitation voltage of the applied voltage and the steady voltage following the overexcitation voltage of the applied voltage is equal to or larger than a predetermined value, it is preferable that the controller 3 output, to the control circuit, a command to decrease the overexcitation voltage from the next attracting operation.

According to this configuration, it is possible to prevent the difference between the overexcitation voltage applied at the initial stage of excitation and the subsequent steady voltage from becoming excessive, and to prevent a decrease in the magnetic force when shifting from the overexcitation voltage range to the steady voltage range.

Furthermore, in the present invention, it is preferable that the controller 3 determine a first correction amount of the applied voltage according to an excess of the output current with respect to the threshold value A, determine a second correction amount of the applied voltage according to an excess of the magnet load with respect to the threshold value B, and output, to the control circuit 200, a command to decrease the applied voltage by a larger correction amount of the first and second correction amounts.

According to this configuration, the applied voltage is decreased by using the larger correction amount of the first correction amount determined by "the correction control based on the output current" and the second correction amount determined by "the correction control based on the magnet load". Accordingly, it is possible to reliably prevent deterioration of the magnet 10.

The invention claimed is:

1. A control device for a lifting magnet, the control device comprising:

a control circuit for controlling power supply from a power source to the lifting magnet;

a current detector for detecting output current to the lifting magnet; and a controller for receiving a signal from the current detector and outputting a command to the control circuit, wherein when at least one of a value of the detected output current and a magnet load is equal to or larger than a first threshold value predetermined for the value of the detected output current or a second threshold value predetermined for the magnet load, the controller outputs, to the control circuit, a command to decrease voltage applied to the lifting magnet from next attracting operation, wherein the magnet load is defined by:

$$\text{Magnet load}=\text{excitation ratio}\times I\times V, \text{ wherein}$$

Excitation ratio: excitation time/(excitation time+non-excitation time),

I: value of the output current, and

V: voltage applied to the lifting magnet.

2. The control device for the lifting magnet according to claim 1, wherein in a case where the controller performs control to decrease the applied voltage when the value of the detected output current is equal to or larger than the first threshold value, the controller outputs, to the control circuit, a command to decrease the applied voltage when an average value of the detected output current in a steady voltage range of the applied voltage is equal to or larger than the first threshold value.

3. The control device for the lifting magnet according to claim 1, wherein in a case where the controller performs control to decrease the applied voltage when the value of the detected output current is equal to or larger than the first threshold value, the controller outputs, to the control circuit, a command to decrease steady voltage of the applied voltage.

4. The control device for the lifting magnet according to claim 1, wherein in a case where the controller performs control to decrease the applied voltage when the magnet load is equal to or larger than the second threshold value, the controller outputs, to the control circuit, a command to decrease both an overexcitation voltage of the applied voltage and a steady voltage following the overexcitation voltage.

5. The control device for the lifting magnet according to claim 4, wherein when a difference between the overexcitation voltage of the applied voltage and the steady voltage following the overexcitation voltage of the applied voltage is equal to or larger than a predetermined value, the controller outputs, to the control circuit, a command to decrease the overexcitation voltage from the next attracting operation.

6. The control device for the lifting magnet according to claim 1, wherein the controller determines a first correction amount of the applied voltage according to an excess of the value of the detected output current with respect to the first threshold value, determines a second correction amount of the applied voltage according to an excess of the magnet load with respect to the second threshold value, and outputs, to the control circuit, a command to decrease the applied voltage by a larger correction amount of the first and second correction amounts.

* * * * *